United States Patent [19]

Gertsch

[11] Patent Number: 4,781,630

[45] Date of Patent: Nov. 1, 1988

[54] MUSCULAR FORCE ACTUATED VEHICLE

[75] Inventor: Ulrich Gertsch, Steffisburg, Switzerland

[73] Assignee: Gertsch Product Innovation AG, Steffisburg, Switzerland

[21] Appl. No.: 44,430

[22] PCT Filed: May 30, 1986

[86] PCT No.: PCT/CH86/00074

§ 371 Date: Mar. 24, 1987

§ 102(e) Date: Mar. 24, 1987

[87] PCT Pub. No.: WO86/07028

PCT Pub. Date: Dec. 4, 1986

[30] Foreign Application Priority Data

May 31, 1985 [CH] Switzerland ..... 4066/84
Jul. 8, 1985 [CH] Switzerland ..... 2041/86

[51] Int. Cl.[4] ..... B63H 16/16

[52] U.S. Cl. ..... 440/24; 440/25; 440/32; 280/258

[58] Field of Search ..... 440/24, 25, 32; 280/242, 253, 255, 258, 244; 105/86, 87, 88

[56] References Cited

U.S. PATENT DOCUMENTS

| | | | |
|---|---|---|---|
| 111,681 | 2/1871 | Repetti | 440/24 |
| 312,071 | 2/1885 | Batz | 440/24 |
| 578,815 | 3/1897 | Fryer | 440/24 |
| 720,534 | 2/1903 | Norton | 440/24 |
| 873,697 | 12/1907 | Fell et al. | 440/32 |
| 929,174 | 7/1909 | Thibert | 114/144 R |
| 1,032,886 | 7/1912 | Felder | 440/32 |
| 1,165,375 | 12/1915 | Abramski | 440/25 |
| 1,793,528 | 2/1931 | Szabo | 440/32 |
| 2,633,096 | 3/1953 | Rayfield | 440/24 |
| 2,751,876 | 6/1956 | Ogilvie | 440/25 |
| 3,139,061 | 6/1964 | Johnson | 440/24 |
| 4,583,754 | 4/1986 | Seeliger | 280/255 |
| 4,639,007 | 1/1987 | Lawrence | 280/244 |

FOREIGN PATENT DOCUMENTS

| | | | |
|---|---|---|---|
| 766327 | 9/1971 | Belgium . | |
| 917712 | 9/1954 | Fed. Rep. of Germany . | |
| 403916 | 3/1943 | Italy | 440/24 |
| 237547 | 4/1945 | Switzerland . | |
| 376016 | 4/1964 | Switzerland . | |
| 22660 | of 1913 | United Kingdom . | |

*Primary Examiner*—Sherman D. Basinger
*Assistant Examiner*—Thomas J. Brahan
*Attorney, Agent, or Firm*—Sherman and Shalloway

[57] ABSTRACT

On the vehicle are mounted an actuation member, a force transmission unit and a drive element. Preferably, the actuation member is comprised of two levers, each of them being fixed to a metal cable each connected to a chain, the two chains actuating the wheels of a gearbox. The latter acts on the drive element which sets in motion the vehicle. A sliding seat enables to transmit the maximum of muscular power to both levers. One or a plurality of free wheels transform the reciprocating motion of the levers into a unidirectional motion for the drive element. With this vehicle, it is possible to optimally transform the muscular energy into driving power.

5 Claims, 15 Drawing Sheets

MUSCULAR FORCE ACTUATED VEHICLE

The present invention relates to a vehicle which is actuated by muscular force as described in the introductory clause of claim 1.

Such vehicles have been in existence for decades, even centuries in the form of rowing boats, for example. However, because of the disadvantageous lever arms of the oars, a comparatively great effort is necessary to propel the rowing boat, and even the greatest effort results only in a very modest speed.

Attempts have been made for many years to overcome these and other disadvantages of the conventional rowing boat, as is evidenced by the following specifications:

In CH-A-No. 376 016 there is described a float in which a person in prone position can operate two levers, which, by person in prone position can operate two levers, which, by means of free wheeling axles and pinoins, and toothed gears, can rotate the propellers. This type of propulsion is very disadvantageous, not only from the ergonomical point of view, but also because the propellers are operated discontinuously. CH-A-No. 237 547 on the other hand, describes a paddle wheel propulsion method as used in contemporary pedalos, essentially consisting of an offset shaft on which paddle wheels are mounted, the shaft being rotated like a cam by means of a rod by the to-and fro-movement of a lever. This method is disadvantageous because the force is sinusoidally transmitted, and each to-and fro-movement of the lever has to overcome two dead centres.

The boat proposed in GB-A-No. 22,660 is equipped with a plurality of lever pairs acting on a common rod, which, by means of a knee lever and an additional rod and cam, or by means of a ratchet and pawl mechanism, rotate a toothed gear. The latter is in engagement with a pinion located at one end of a propeller shaft, and drives a propeller. However, as stated above, this design is disadvantageous and does not provide an optimum conversion of the bodily strength acting on the lever into forward thrust.

A similar watercraft is proposed by U.S. Pat. No. 1,793,528, according to which a cam gear is driven by means of a lever bar, which, in turn, either rotates a propeller by means of a drive unit, or a paddle wheel by means of belt. But this design does not produce optimum results either, because of the aforementioned reasons.

The torpedolike device according to DE-C-No. 917 712 also employs a cam gear, which, in this instance, is rotated by use of the body weight. This method is, however, again ergonomically disadvantageous, since it is impossible to achieve longterm performance by repeatedly rising from an sitting down on a seat designed to act as a lever.

BE-A-No. 766 327 likewise proposes a boat in which a cam gear is rotated by means of a lever bar, in order to drive in turn either a propeller or a paddle wheel. Therefore, this solution is also disadvantageous and requires further improvement.

In other vehicles of known construction that are actuated by muscular force, similar disadvantages occur. Here reference is merely made to the bicycle which has also been available for decades. As is well known, it is propelled by means of pedals and a sprocket wheel, by means of which a chain acts on the rear wheel. The disadvantage of this propulsion system is due to the fact that it only utilizes the leg muscles. Furthermore, the length of the pedals is fixed and the effect of the muscular effort is therefore limited.

It is the object of the present invention to overcome the above disadvantages and to design a vehicle in which optimum use is made of the general laws of physics on the one hand, and in which, on the other hand, optimum ergonomical use is made of the whole body, to achieve the greatest possible propulsion speed by moving the whole body and using its most varied muscle sections.

In accordance with the invention this task is solved by means of a vehicle as defined in claim 1. This vehicle may be a watercraft, a wheeled vehicle for use on land or a tracked vehicle for use in snow-covered areas, or even a light plane with propeller.

The advantages of the vehicle according to the invention will become apparent in the following description of various embodiments in the form of watercraft: The individual embodiments are illustrated in the accompanying drawings in which.

Figure 1:
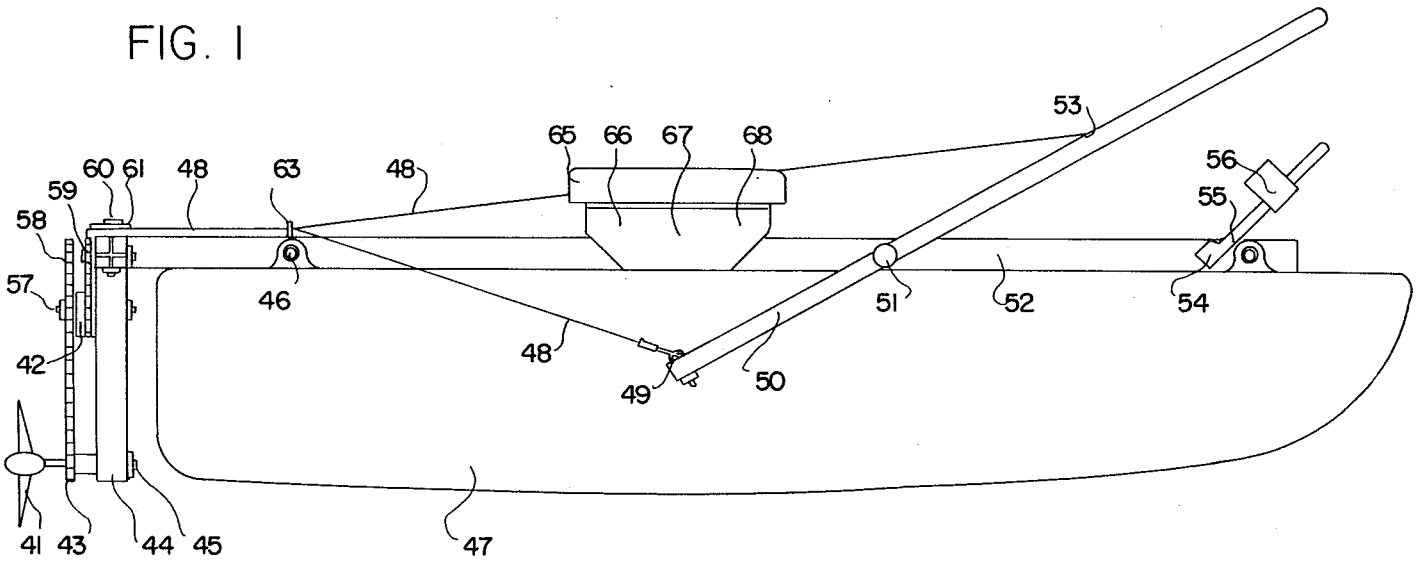
FIG. 1 is a side view of a first embodiment of a propeller driven boat.
Figure 2:
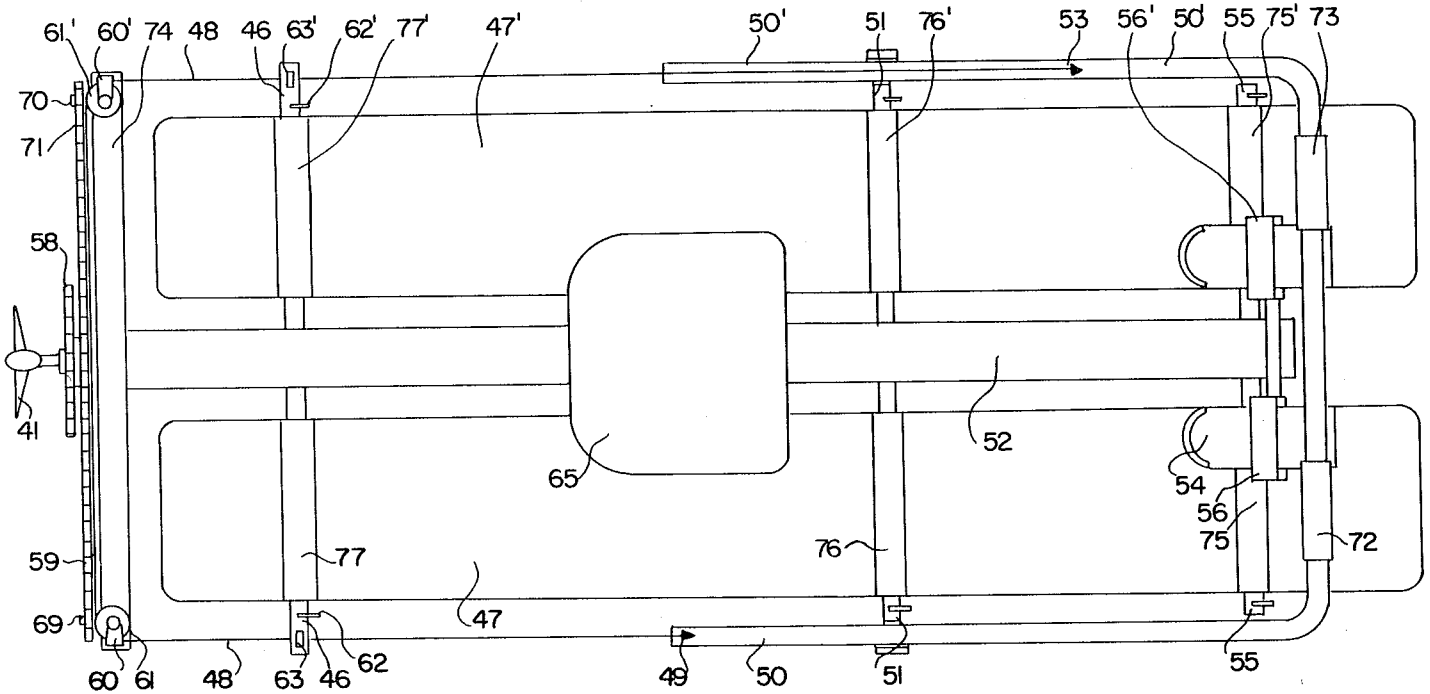
FIG. 2 is a plan view of the embodiment of FIG. 1.
Figure 3:
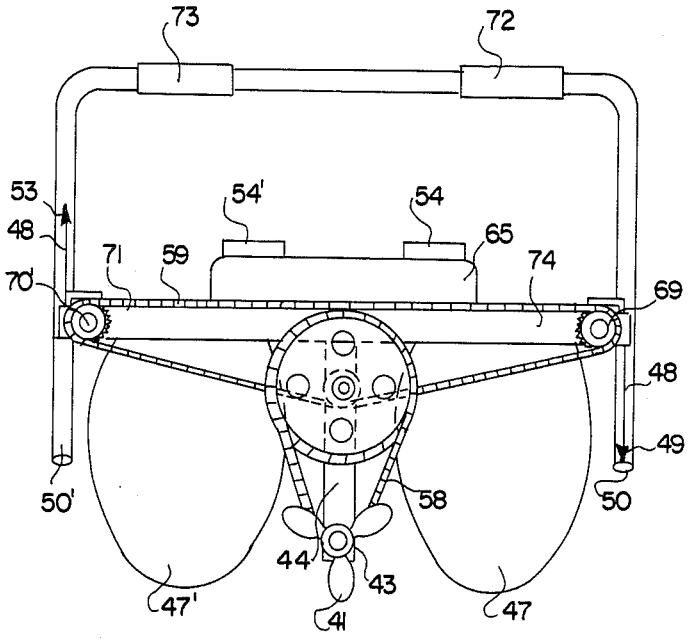
FIG. 3 is a rear view of the same embodiment.

Like a catamaran, the first embodiment of a propeller driven boat according to FIGS. 1, 2 and 3 comprises two float elements 47, 47', which may be constructed of inflatable rubber or plastic, for example. On their top surface these float elements 47 and 47' are provided with ribs 75, 76, 77 or 75', 76', 77', which are preferably vulcanized or injection moulded to said surface, while chanel like recesses pass through said ribs. Connecting tubes 46, 51 and 55 pass through these recesses and connect float elements 47 and 47' to a carrier member 52. Preferably, said carrier member 52 consists of a rectangular profile tube. It serves to stabilize the whole of the boat on the one hand, and, on the other hand, it also forms a slide rail at the rear of the boat for sliding seat 65. This sliding seat 65 is known per se, as it is used, for example, in racing boats to support the arm action with the strength of both legs. 67 identifies two identical supporting members located both to the right and left of carrier member 52. Said members support seat 65 and also accommodate rollers 66 and 68. Foot supports 54, 54' are firmly fixed to the front end of carrier member 52 and are equipped with adjustable foot straps 56, 56'. A double lever 50, 50' is swivellably mounted on connecting tube 51, on an axle or axis extending transversely to the longitudinal centre line of the boat. It is the actual propulsion lever and is manually pivotable fore-and aft.

A wire rope 48 is attached to the lower end of lever 50, preferably by means of an eyebolt 49. This wire rope 48 passes through a guide eye 63, around guide pulleys 61, 61' and through a guide eye 63' to the upper section of the other lever 50', where the connection between cable and lever is preferably again established by means of an eye bolt 53. The distance between eyebolt 49 and the bearing point of lever 50 on the connecting tube 51' is identical with the distance between the bearing point of of lever 50' on the connecting tube 51' and the eyebolt 53. Double lever 50, 50' and wire rope 48 form a closed circle. When double lever 50, 50' is moved rearwards towards the end of the boat—at its grip points 72, 73 by hands and arms with the assistance of the overall bodily strength, then point 71 (FIG. 2) of wire rope 48 moves away from guide pulley 61' towards guide pulley 60. When double lever 50, 50' is again swivelled to the front—towards the stem of the boat - point 71 of the wire rope 48 returns to guide pulley 61'.

At the rear end of supporting member 52 a T-member 44, 74 is firmly attached to said supporting member. The actual transmission and propulsion system of the boat is disposed on this T-member 44, 74. This is most clearly shown in FIG. 3, which represents a rear view, and where it will be seen that at 71 wire rope 48 is firmly coupled to a first sprocket chain 59. This chain 59 passes over guide pulleys 69, 70 and a small covered first gear wheel **57*a*. This first gear wheel 57*a* is rotatably mounted on an arm 44 on the one hand and on the other hand is joined to a large second gear wheel 57*b*. A second gear chain 58 passes from large gear wheel 57*b* to a third smaller gear wheel 43, which is firmly joined to a propeller 41 and is likewise disposed on the arm 44 of T-member 44, 74**.

The connection between the first gear wheel **57*a* and the second gear wheel 57*b* is preferably formed by a free-wheel bearing 42, so that the second gear wheel 57*b* is only driven, and thus rotated, in one direction—namely clockwise—by the first small gear wheel 57*a***.

In this particular embodiment of the boat, propeller 41 is actuated in the following manner: double lever 50, 50' is manually pulled backwards, i.e., towards the stern of the boat, at grips 72, 73, causing wire rope 48 to be pulled in anticlockwise direction through guide eyes 63, 63' and guide pulleys 61, 61' (FIG. 2). Since wire rope 48 is firmly coupled at 71 to the first gear chain 59, the latter is moved in clockwise direction in FIG. 3, causing first gear wheel **57*a* and therefore also second gear wheel 57*b* to rotate, so that second gear chain 58 is likewise set in motion, and in turn rotates third gear wheel 43 and thus propeller 41 in clockwise direction. The movements of wire rope 48, gear chains 50 and 59', gear wheels 43,57*a* and 57*b*, and finally of propeller 41 continue until the connecting element between wire rope 48 and first gear chain 59 is moved against guide pulley 61 at point 71, or, respectively, until double lever 50, 51 has been completely pulled down towards the rear, whereupon double lever 50, 50' must immediately be pushed forward, just like the oars of a rowing boat, which have to be raised out of the water at the end of a stroke and be returned towards the front (in the direction of movement), so as to be immersed again. This forward pivoting of double lever 50, 50' is performed without load as it were, i.e., it does not cause propeller 41 to move in anticlockwise direction, since, as has previously been mentioned, a free-wheel bearing has been inserted between first and second gear wheels 57*a* and 57*b***. Hence, the whole propulsion system is of a ratchetlike nature.

By means of a wire rope passing in opposite direction over additional guide pulleys, it is possible to move additional gear chains and gear wheels each in opposite direction, so as to produce continuous propulsion of propeller 41, both forward and backward swivelling of double lever 50, 50' continuously driving propeller 41 in the same direction.

It is also, of course possible to transmit the propulsion movement simultaneously to two or more propeller, if the additional material cost is accepted.

It should also be pointed out that the first gear chain 59 (FIG. 3) can co-operate directly with third gear wheel 43 and propeller 41, if the aforementioned free-wheel bearing 42 is inserted between third gear wheel 43 and propeller 41. This arrangement requires substantially fewer components, however, elimination of the transmission system formed by gear wheels **57*a*, 57*b* and 43 together with gear chains 58 and 59**, considerably reduces the revolutions per minute of the propeller.

Figure 4:
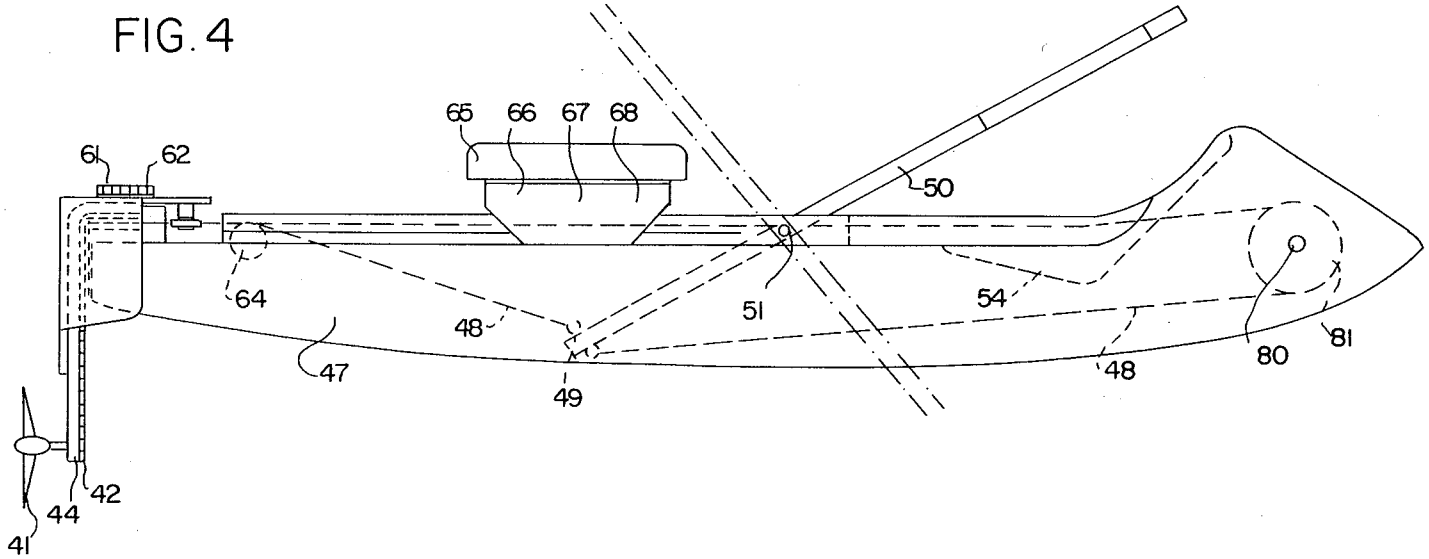
FIG. 4 is a side view of a second embodiment of a propeller driven boat.
Figure 5:
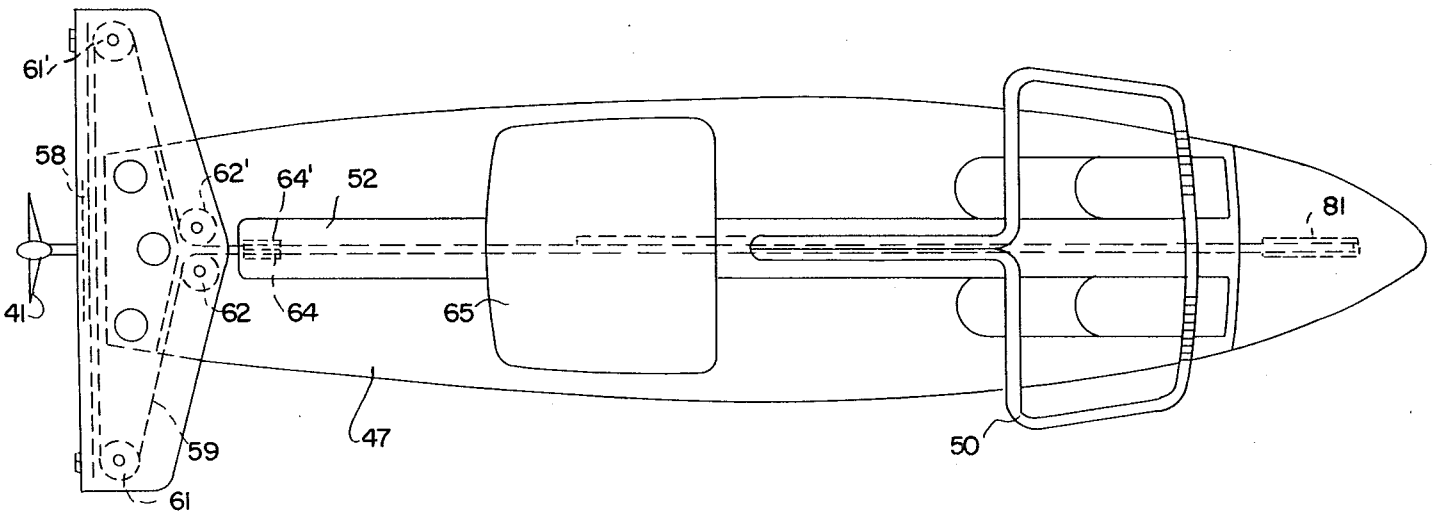
FIG. 5 is a plan view of the boat of FIG. 4.
Figure 6:
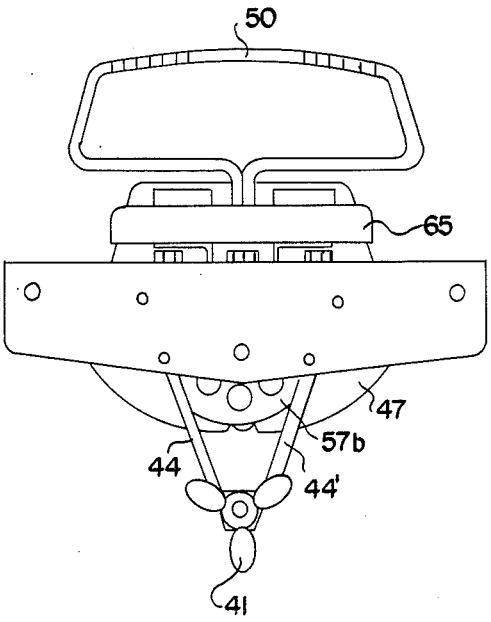
FIG. 6 is a rear view of the same embodiment.

A second embodiment of a propeller driven boat is illustrated in FIGS. 4, 5 and 6, where parts that correspond to those shown in FIGS. 1 to 3 are identified by the same reference numerals. This embodiment employs a one-armed lever 50, making it necessary for the wire rope 48 to be arranged differently, and to be guided in the opposite direction from lever 50, namely on the one hand directly to drive mechanism **43, 57*a*, 57*b*, 58, 59 and on the other hand indirectly via a guide pulley 81, said pulley being mounted on a shaft 80. Due to the central arrangement of wire rope 48 in this embodiment of the boat, four additional guide pulleys 62, 62' and 64, 64' are required at the rear end of supporting member 52, to ensure that the wire rope is guided correctly. However, guide eyes 63, 63'** are eliminated. Here again the traction member forms a closed circle. It is a characteristic of this embodiment that the cables are not visible, and therefore do not interfere either functionally or optically. This means that the cables are passed through the water, which, thanks to their small diameter does not cause any interference.

Figure 7:
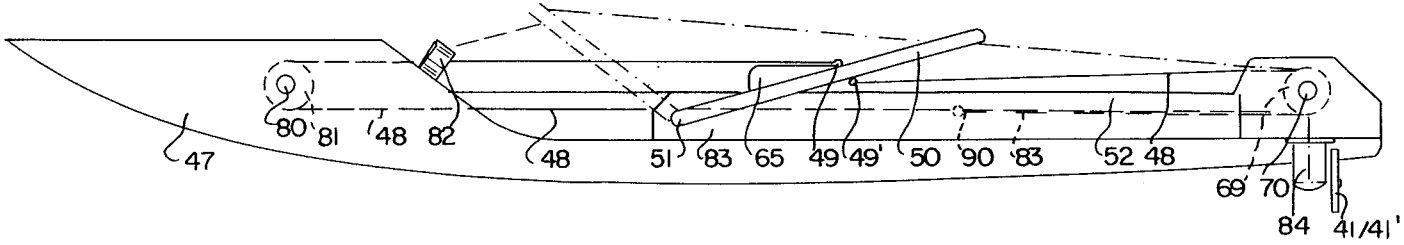
FIGS. 7 and 8 illustrate side and plan views of a third embodiment of a propeller driven boat.
Figure 8:
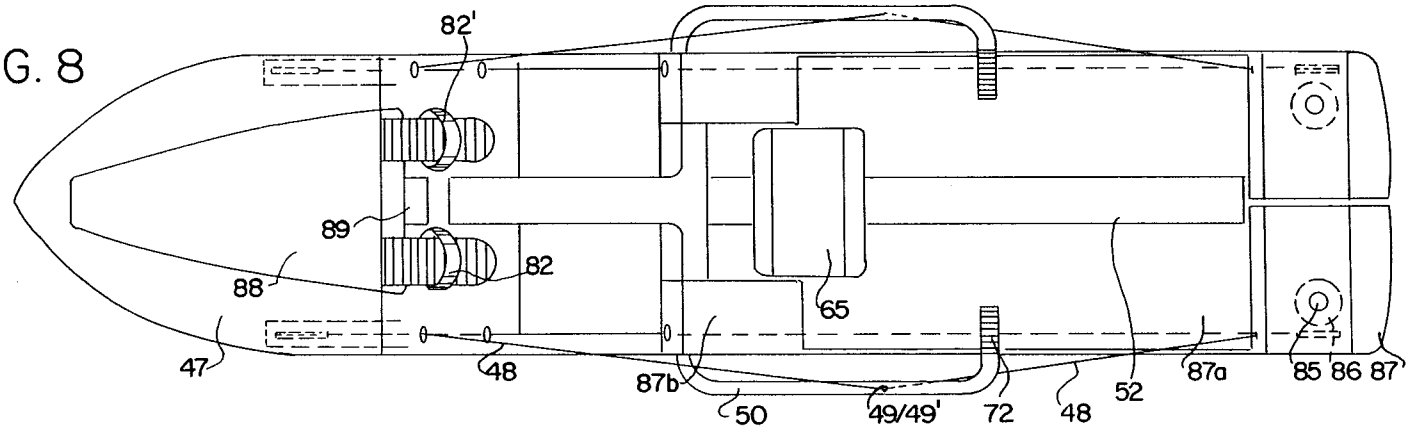

A third embodiment of a boat in accordance with FIGS. 7 and 8 is largely identical with that of FIGS. 4 to 6. However, it differs from the former in that the wire rope or ropes 48 are fastened by eyebolts 49, 49' in the upper area of double lever 50, 50' and are therefore visible, i.e., they do not pass through the water, thus facilitating the elimination of possible sealing and rust problems of the preceding embodiment. Transmission of the propulsive movement to the propeller 41 represents another difference of this embodiment. It is effected in this embodiment be means of two propulsion systems which are independent of one another and which actuate two propellers 41 and 41', and results in an increase of speed, and, by additionally varying the intensity of movement of one lever relative to the other, it becomes possible to steer the boat by means of differential steering. As shown in FIGS. 7 and 8, guiding gear rollers 69, 69' are rotatably disposed on an axle 71, which extends transversely to the longitudinal boat axis. They preferably operate together via bevel gear 84 of known construction with propellers 41, 41', and are driven by chain sections 83 or 83', which are continued in the form of wire rope 48 from coupling points 90 or 90'. In all other respects the drive or propulsion operates analogously to that of FIGS. 4 to 6. 88 identifies the cover of a small storage space at the head of the boat, while 89 identifies a hand slot for opening the cover. Adjustable foot strap s of conventional design are identified by 82 or 82'.

The function of body parts 87, 87*a* and 87*b*, which are advantageously provided are described at a later stage with reference to FIG. 13.

Figure 9:
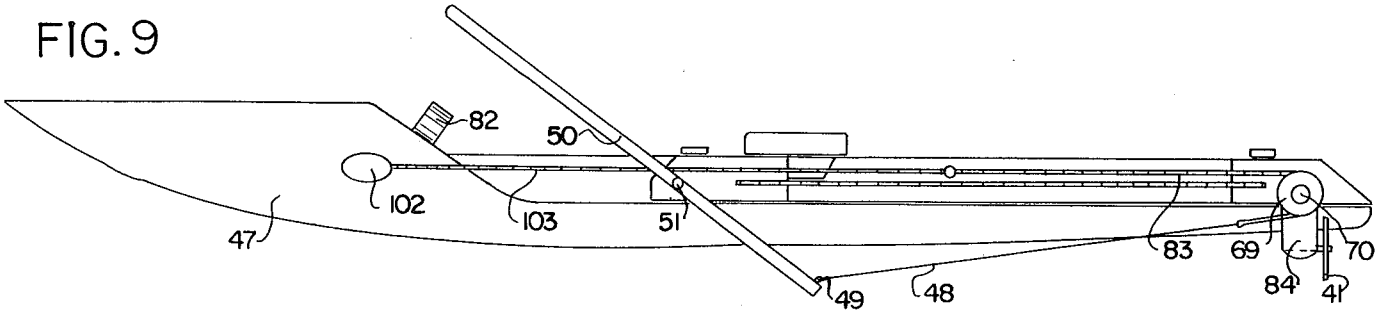
FIGS. 9 and 10 represent side and plan views of a fourth embodiment of a propeller driven boat.
Figure 10:
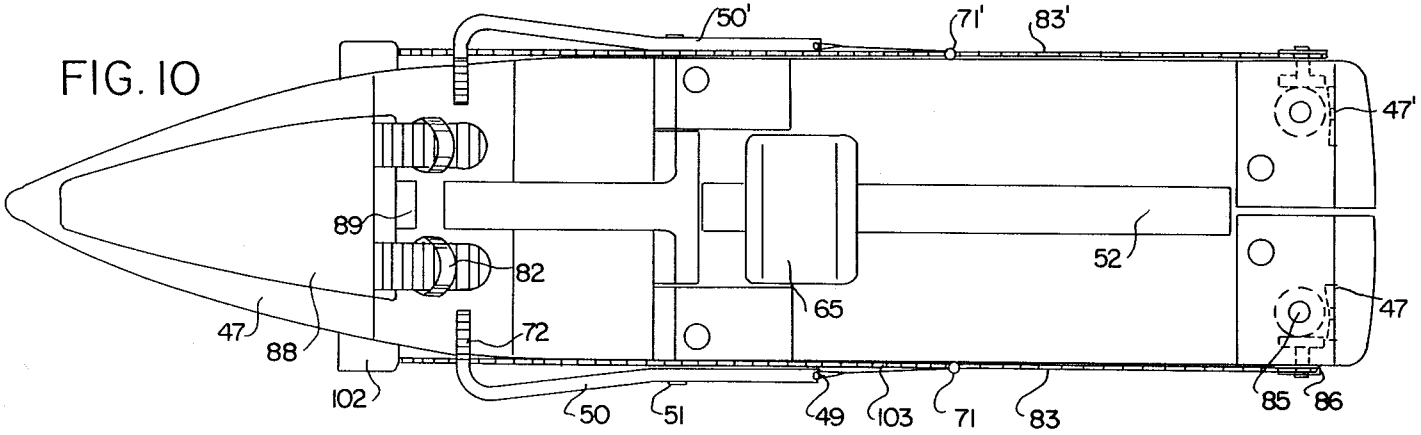

With reference to its drive kinematics, the third embodiment of the boat according to FIGS. 9 and 10 is identical to that of FIGS. 7 and 8. There is, however, a difference in the construction of the wire rope and its attachment. As shown in the drawings, the ends of the wire ropes are attached to the lower end of the extended double lever 50, 50'. Hence, part of the two wire 48, 48' passes through the water. In order to assure optimum propulsion, wire ropes 48 are again coupled to chain lengths 83, 83' at coupling points 71, 71'. However, instead of chain lengths 83, 83' again being coupled at their other ends to a wire rope 48, 48', they are attached there to an elastic rope 103 or an elastic cord, or are joined to an elastic element the front end of which is firmly anchored to the boat at 102. At the moment of propulsion, i.e., when double lever 50, 50' is pulled back, these rubber ropes 103, 103' are stretched, in order to again pull back the associated chain lengths 83, 83' into their starting position during the subsequent stroke phase. This is possible, thanks to the free-wheel bearings 42, 42' on guide sprockets 69, 69,, and does not reverse propellers 41.

This arrangement of wire ropes 48, 48', chain lengths 83, 83 and elastic traction organs 103, 103' eliminates guide roller 81 at the front of the boat, (FIGS. 4 to 6).

Figure 11:
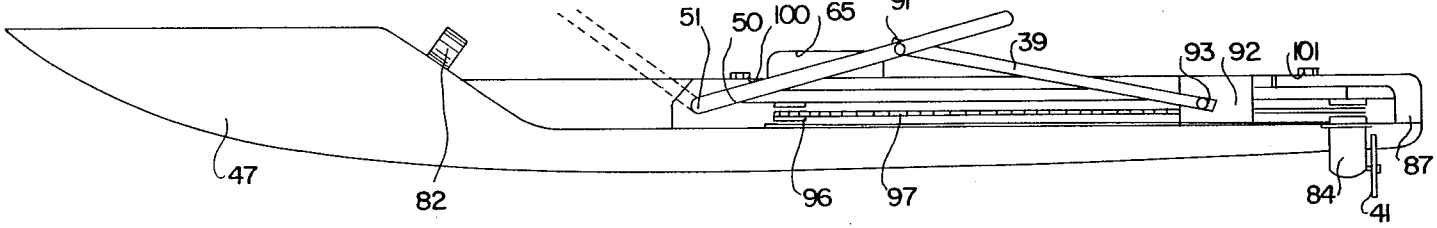
FIGS. 11 and 12 represent side and plan views of a fifth embodiment of a propeller driven boat.
Figure 12:
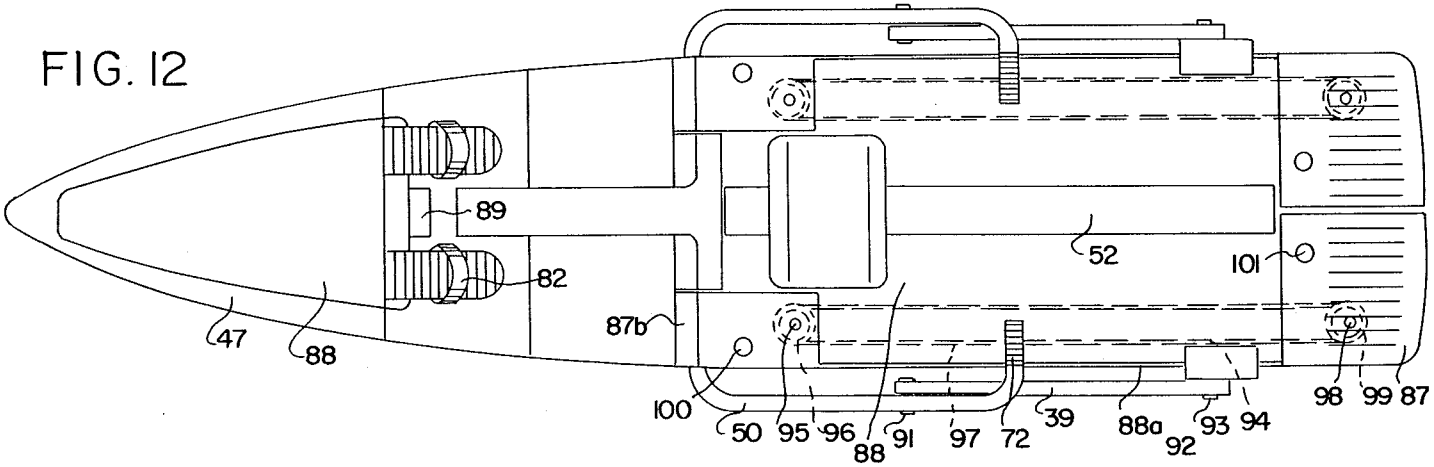

The propulsion arrangement illustrated in FIGS. 11 and 12 differs from that previously described, in that the two wire ropes 48, 48' are replaced on both sides of the boat by solid rods or bars 39, which, similar to connecting rods are swivellably connected on the one hand by a hinge 91 to the double lever 50, 50' and, on the other hand by a hinge 93 to a slide 92. Slide 92 extends parallel to the longitudinal centre axis of the boat on a rail 88*a*, constructed as angular lateral limitation of supporting body part 87*a*. A coupling member 94 links slide 92 to a chain 97, which is disposed horizontally under body part 87*a*.

Chain 97 extends over sprocket wheels 96 and 99, which are arranged on body part 87*a* and bearing parts 87 and 87*b*, which are joined to the former.

As shown in the drawings, propulsion is produced in that slide 92 is moved rearwards by rod or bar 90, thereby moving chain 97 and rotating sprocket 99. In turn, sprocket 99 actuates propeller 41 via a bevel gear 84, which is conventionally arranged in a housing. Since sprocket 99 is advantageously provided on one side with a free-wheel device, analogous to the sprockets of modern bicyles, it is ensured that during the subsequent return stroke movements of double lever 50, 50' and the resulting forward movement of slide 92, propeller 41 does not rotate in the opposite direction.

The advantages offered by the embodiment of FIGS. 11 and 12 are now described with reference to FIG. 13, which demonstrates that both a lefthand and a righthand propulsion system can each be constructed as a self contained unit, which is preferably assembled in the workshop and which the owner can attach or detach from the hull without difficulty. Sliding set 65 can also be easily detached. Only carrier member 52, which is advantageously constructed of aluminium, is attached to the boat hull 47. It acts on the one hand as a slide rail for sliding seat 65, which can be slid in from the rear, and, on the other hand, it forms part of the holding components of the supporting body or slide parts 87 and 87*a*, which can clip into slide 52 with their inner edge.

Body parts 87*a*, 87*a'* consist advantageously of flat rectangular plates (of aluminium, for example), which are bent upwards at their outer edges.

The bars 88*a*, which project at an angle from body parts 87*a*, 87*a'*, act as carrier for slides 92 and 92', and in addition strengthen body parts 87*a*, 87*a'* in longitudinal direction (profile). To the front and rear of body parts 87*a*, 87*a'* there are firmly attached body parts 87*b*, 87 or 87*b'*, 87', on which sprocket wheels 96, 99 are disposed, while; the front body part 87*b* has disposed thereon in addition the divided double lever 50, 50', which, in the assembled condition of the boat, engages with its ends 50*a*, 50*a'* in a bearing bore 47*g* of superstructure 47*b* of hull 47.

Advantageously, assembly of this boat by the user is performed in such a way that initially sliding seat 65 is slipped on to carrier member 52 from the rear. Subsequently, one structural unit comprising a propulsion system is moved from the side against the hull 47 in such a way that the end 50*a* of lever 50 enters into engagement with bearing bore 47*g* of superstructure 47*b* and the whole of the inner edge of body part 87*a* clips into carrier member 52. Now fastening screws 100, 101, advantageously fitted with plastic heads for convenient handling, are screwed into corresponding screw sockets 47*c*, 47*f* in hull 47, whereupon the particular propulsion element is attached to the hull of the boat. The corresponding assembly method is used for the structural unit and the propulsion element of the other side. 47*d* and 47*e* identify platforms in hull 47, which may provide optimum support for body parts 87, 87*a* and 87*b* or 87', 87*a'*, and 87*b'*.

This construction of the boat, or its division into structural units means that the hull without propulsion elements and without sliding seat is relatively light and flat and, like a surfboard, can therefore be loaded on to a car roof. The propulsion elements can also either be transported on the car roof, alongside the boat hull, or in the car boot, as can the rolling seat.

Assembly and disassembly of the boat can be performed easily and rapidly in line with the above description.

Figure 13:
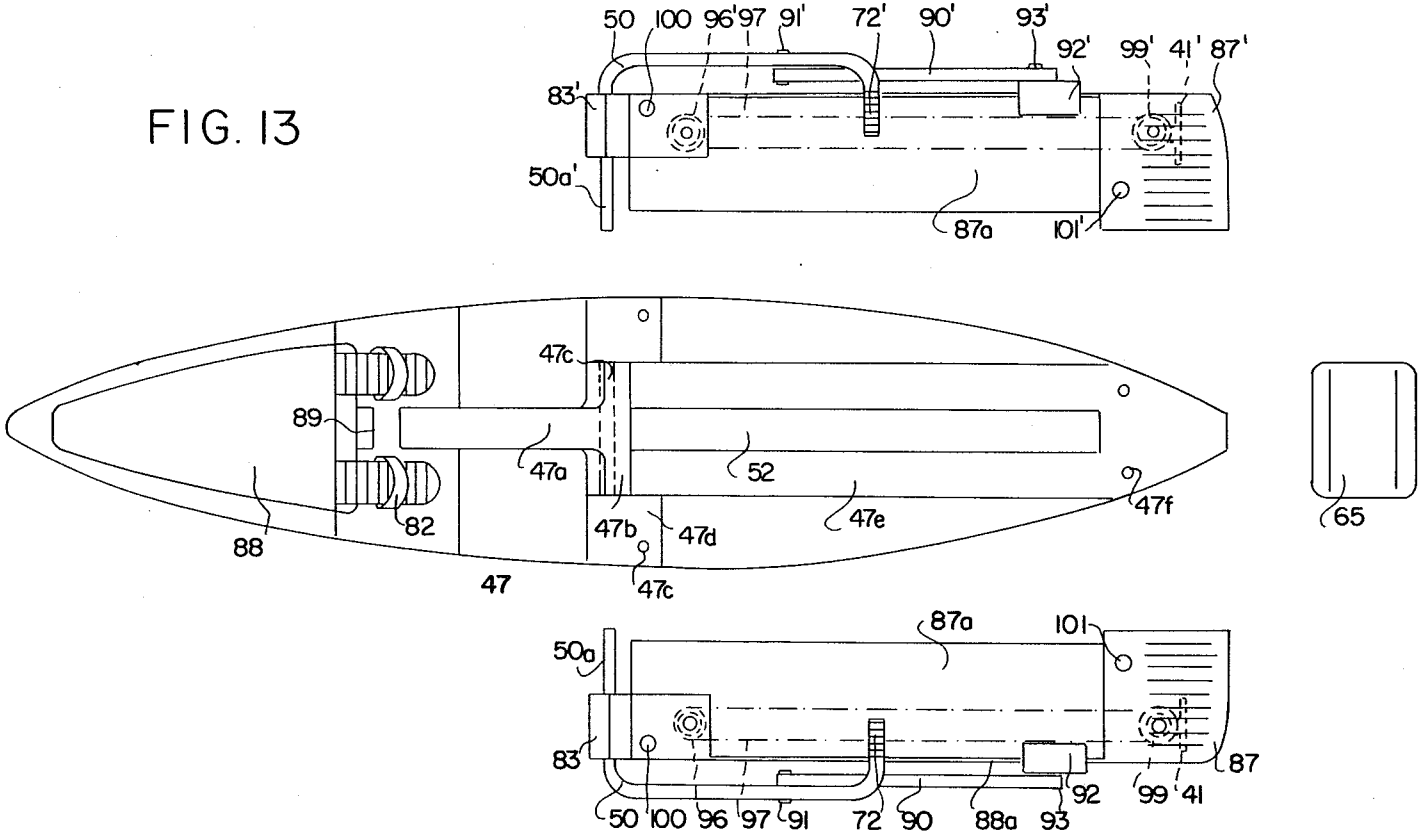
FIG. 13 illustrates the various disassembled component groups of this embodiment.

When designing the embodiment of the boat according to FIGS. 11 to 13, special attention was focused on maintaining a low weight, a low height, low-cost mass-production, low tooling cost and an attractive appearance.

Figure 14:
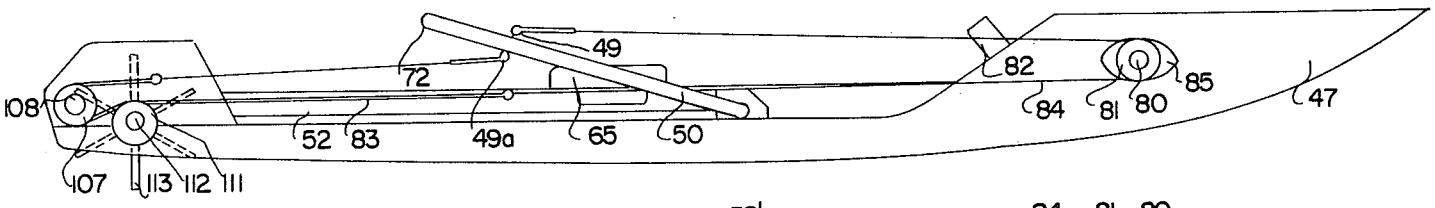
FIGS. 14 and 15 are side and plan views of a first embodiment of a paddle wheel propelled boat.
Figure 15:
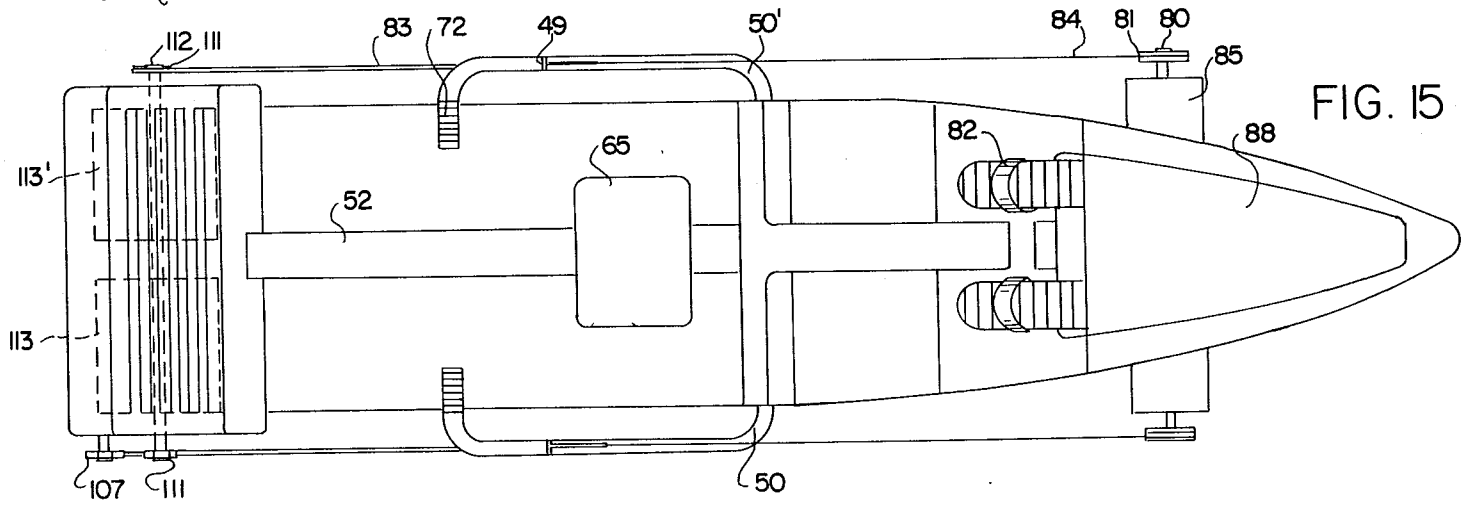
Figure 17:
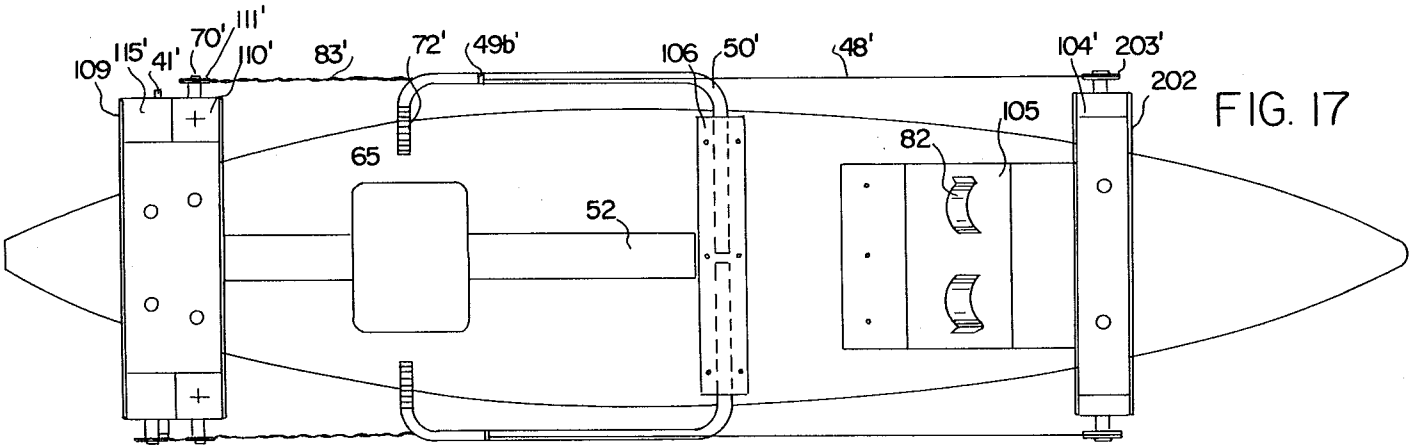
Figure 18:
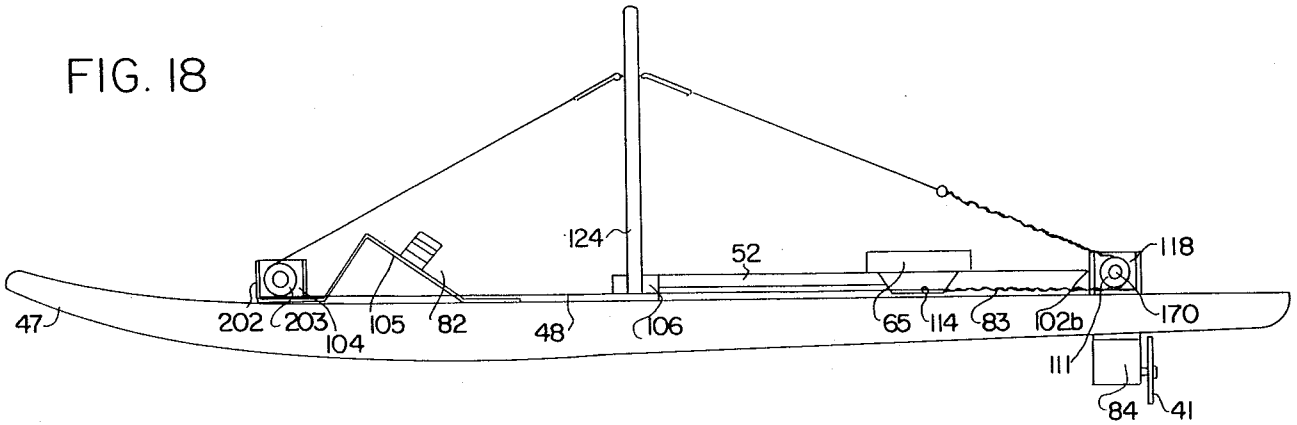
FIGS. 18 to 23 illustrate other similar embodiments of the invention in side or plan view.

Propulsion in the embodiment of FIGS. 14 and 15 essentially corresponds to that of FIGS. 17 and 18, and has been described above. However, the propulsion element of this embodiment of the boat is new, since it is not a propeller as in the above described embodiments, but consists of two independently actuated paddle wheels 113 and 113'. It is an advantage of this design that there is no need for bevel gears or other measures to guide the propulsion movement from one plant into the other, i.e., propulsion is direct. It can be seen from the plan view of this embodiment according to FIG. 15 that on the righthand side of the stern two sprocket wheels 107, 111 are provided, while only one sprocket wheel is provided on the lefthand side. This is due to the fact that sprocket wheel 107, 111 are free-wheel sprocket wheels, as known from bicycle construction, for example, and only drive the paddle wheels 113, 113' when they rotate in clockwise direction. When they rotate in anticlockwise direction, they do not rotate paddle wheels 113, 113': If on the righthand side of the boat according to FIG. 15 only one clockwise driving sprocket wheel were provided, then paddle wheel 113 would not rotate when righthand lever 50 is actuated in the propulsion movement, but would rotate as a result of the stroke movement, i.e., when the lever is being pushed. This would not be practical, since the pushing movement is much less efficient than the pulling movement, due to anatomical and physical conditions. Thanks to a second sprocket wheel 107 and diversion of the chain movement to sprocket wheel 111, righthand paddle wheel 113 is driven as desired during pulling movement on lever 50, i.e., during propulsion movement. When the same sprocket, which drives in clockwise direction, is rotated by 180° and employed on the lefthand side of the boat, then the aforementioned diversion of the propulsion direction is not necessary, and a single sprocket is therefore sufficient. This is the reason for the asymmetrical chain arrangement.

Figure 16:
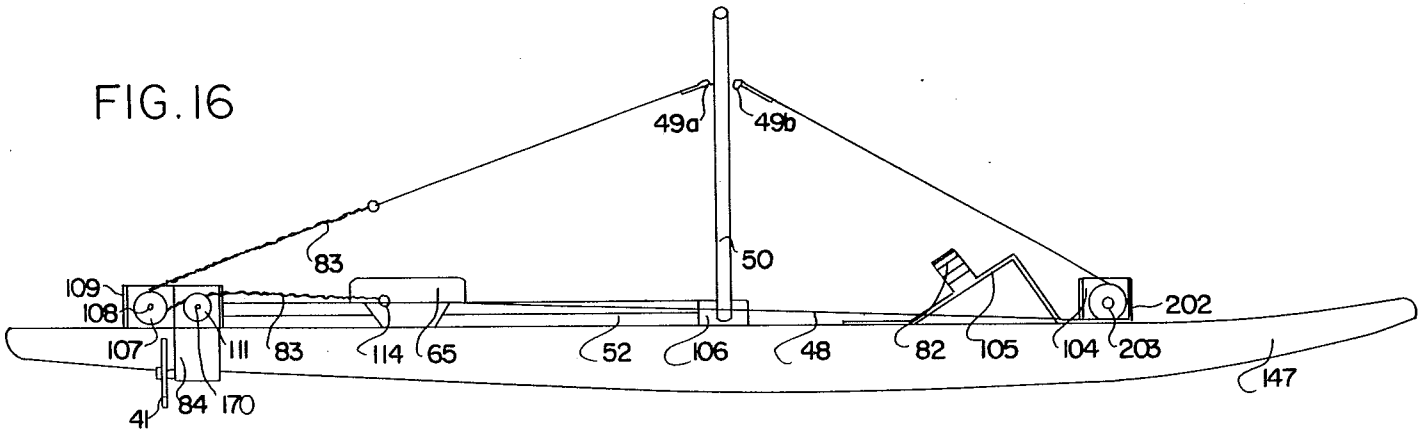
FIGS. 16 and 17 are side and plan views of a sixth embodiment of a propeller driven boat.

FIGS. 16 and 17 represent a sixth embodiment of the propeller driven boat, in which the whole propulsion- and sliding seat mechanism and a foot rest with its straps are disposed on a commercial surfboard. Propulsion is analogous with that of the embodiment illustrated in FIGS. 7 and 8, while the sprocket wheel arrangement is asymmetrical as in FIGS. 14 and 15, to make provision for the use of identical free-wheel sprockets—as mentioned in the description of FIGS. 14 and 15—which propel only in clockwise direction and are equipped with an idling gear for the anticlockwise direction. As an alternative, it is of course also possible to utilize free-wheel sprockets 111 and 111' rotating in opposite directions, thus eliminating the third free-wheel sprocket 107. In the interest of clarity all components of this new embodiment will now be described briefly. 147 identifies the commerical surfboard, to the front of which is screwed a profile section 202, preferably of aluminium. This profile is fitted with bearing parts 104 and 104' for guide rollers 203, 203'. 105 identifies the footrest or foot-ramp, 82 and 82' identify the adjustable footstraps, which when combined with the sliding seat 65, are an essential arrangement for optimum leg function. As usual, sliding seat 65 is disposed slidelike by means of four rollers on carrier member 52. The two levers 50, 50', which are independently movable in this embodiment, are disposed in a bearing element 106. 72 and 72' identify the handles of these levers 50, 50'. The four ends of wire ropes 48 and 48' are attached to levers 50, 50' by means of eyebolts **49*a* and 49*b* or 49*a'* and 49*b'*. In accordance with FIG. 16 wire rope 48 passes forward and downward from eyebolt 49 *a,b* via guide roller 103, it then extends rearwards along the side of the boat and is coupled to chain 83 at 114. The chain may be a commercial bicycle chain, which passes via free-wheel sprocket 111 around auxiliary sprocket 107 forward and upward to wire rope 48, the other end of which is attached to eyebolt 49*a***.

The free-wheeling sprockets 111 and 111' co-operate directly with bevel gears 110 and 110', which divert the rotation movement of sprockets 111 and 111' to the vertical axle, which, in turn, drives propellers 41, 41' by means of bevel gears 84 and 84'. Bevel gears 110 and 110' and bearings members 115, 115' are attached to a profile section 109, advantageously of aluminium construction, which can be screwed to the surfboard. In FIG. 16 double lever 50, 50' is in vertical, neutral position, while in FIG. 17 it is shown at the end of the propulsion stroke and is resting on the rear of the boat. This position is the preferred transport position for this embodiment of the boat. During the raising phase, i.e., when double lever 50, 50' is pushed forward, the free-wheeling sprockets 111 and 111' ensure that propellers 41, 41' do not rotate in the wrong direction, but continue to rotate in the direction of movement until they are reactuated when the levers are pulled back.

Figure 19:
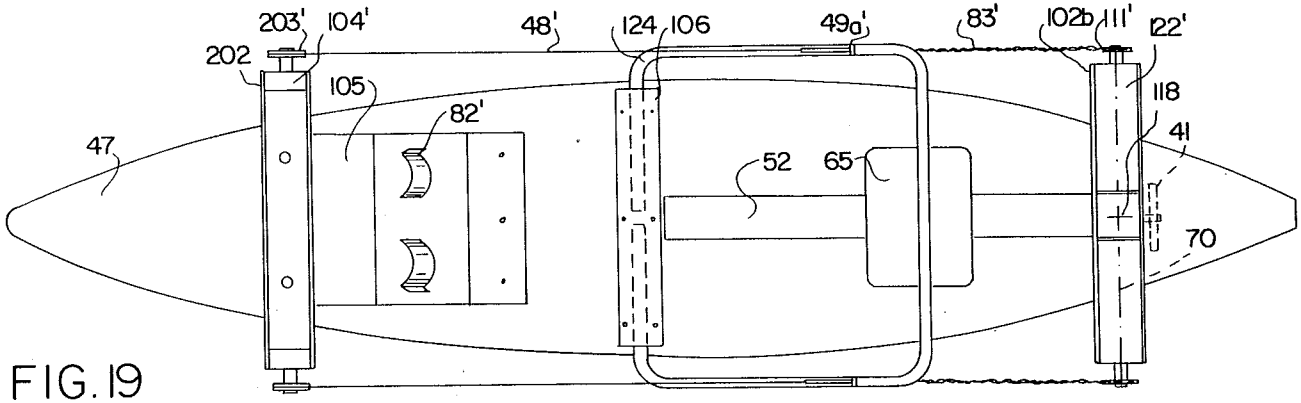

Advantageously, the boat hull of the embodiment according to FIGS. 18 and 19 also consists of a commercial surfboard, and the superstructure of propulsion mechanism and sliding seat mechanism is largely identical with that og the embodiment according to FIGS. 16 and 17, the main difference being that the two levers 50 and 50' of the double lever are firmly joined together. This joined one-piece driving stirrup is identified by reference numeral 124. It is the purpose this design to ensure by simple means that propulsion takes in both the pulling phase and the raising or pushing phase, and therefore is uninterrupted. If it is desired to keep the construction simple, it is appropriate to provide only one propeller 41, namely at the bottom end of the centre line of the surfboard. To ensure that the propeller 41 is actuated without interruption, this embodiment employs only one commercial free-wheel sprocket 111, 111', which rotates in clockwise direction. Thus, the lefthand sprocket wheel 111 drives the propeller 41 during the pulling phase, while the righthand sprocket wheel 111' drives it during the raising or pushing phase. The shaft 170 s propelled in the same direction in both phases. Shaft 170 passes through a bevel gear 118 and there transfers the rotation via bevel sprockets to a vertical shaft, which, in turn, co-operates, i.e., drives Propeller 41 by means of an additional bevel drive 84.

Figure 20:
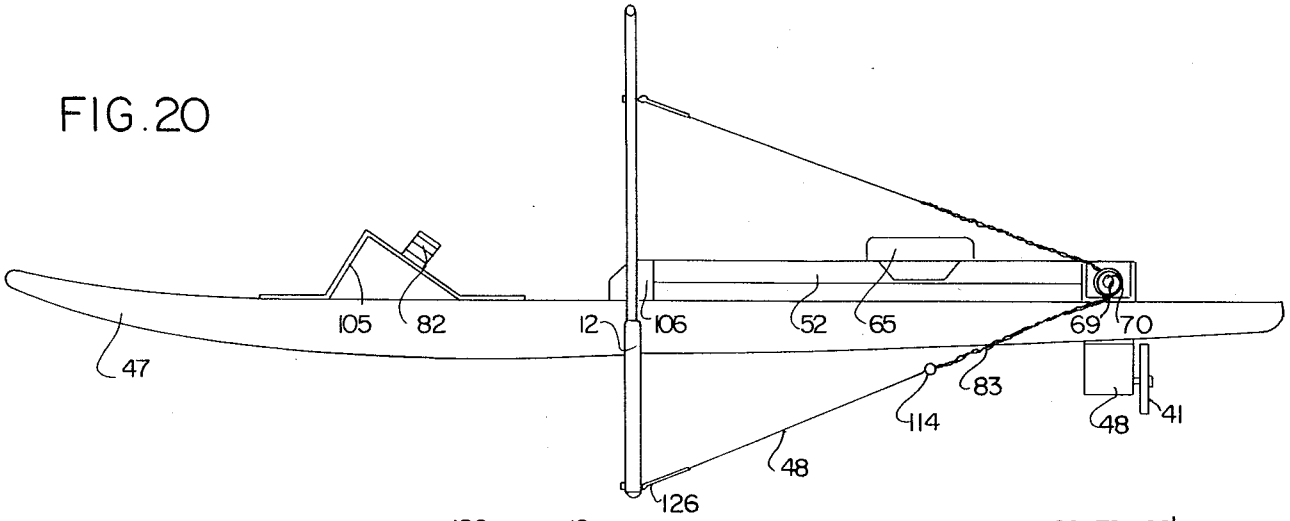
Figure 21:
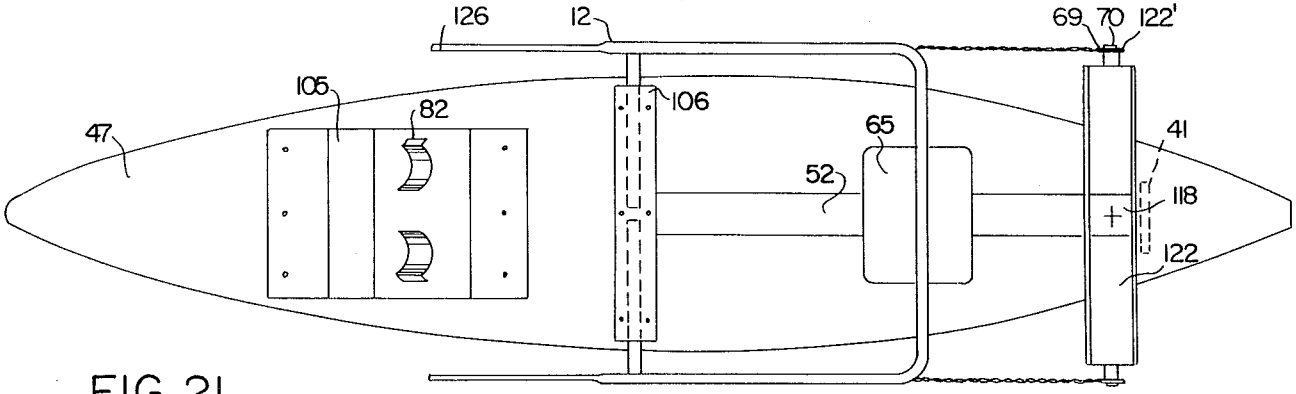

The embodiment illustrated in FIGS. 20 and 21 is fitted with a drive, which, in principle, correspond that illustrated in FIGS. 18 and 19. The only difference between the two embodiments is that the embodiment of FIGS. 20 and 21 does not possess guide rollers 203 at the front f the boat, but utilises instead a double propulsion lever 12, the two free arms of which extend into the water. Since the ross section of these arms is very small, namely equal to a pipe that has been squeezed together, their braking action, can merely occur during the pulling phase, is minimal.

Figure 22:
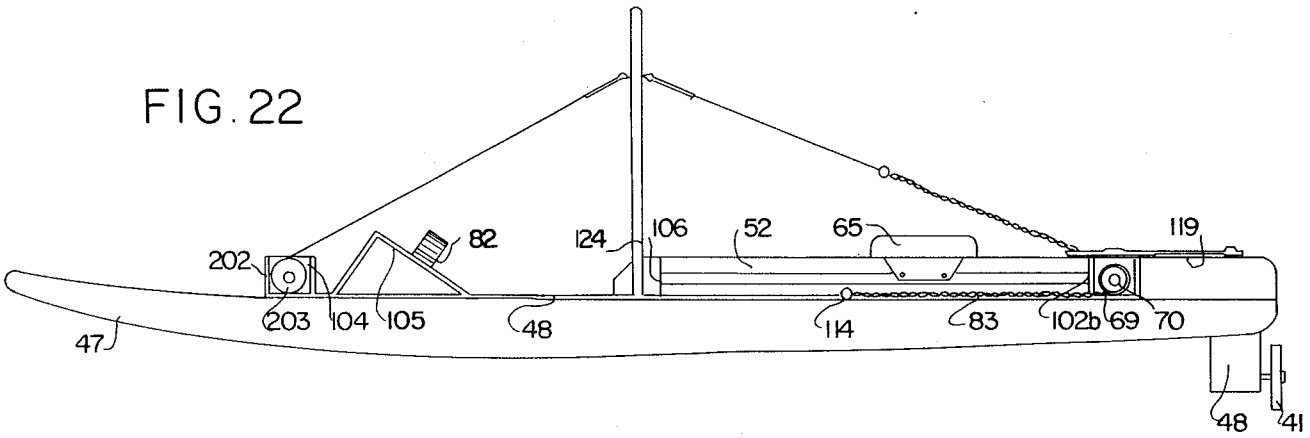
Figure 23:
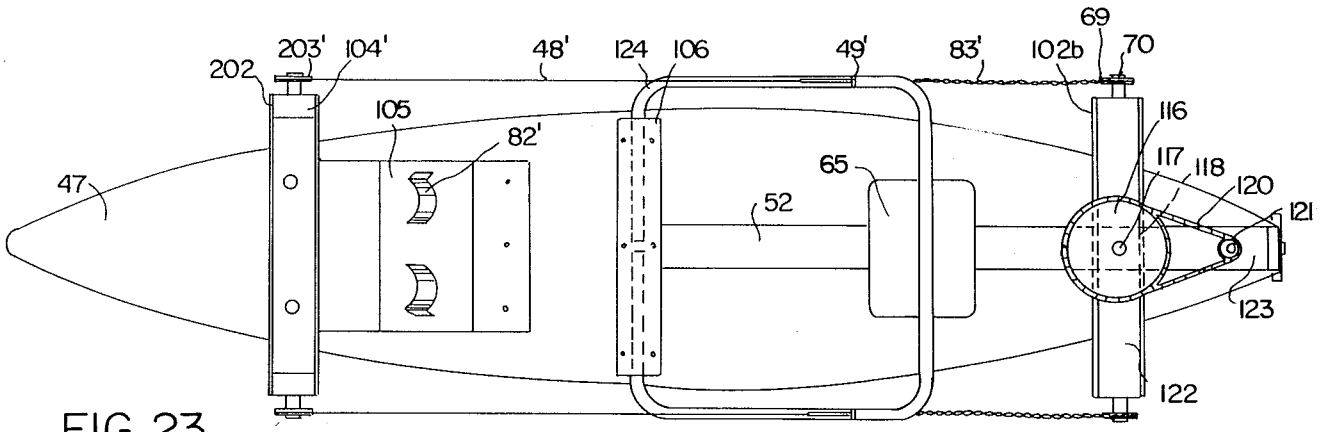

The embodiment according to FIGS. 22 and is identical to that of FIGS. 20 and 21 with regard to its propulsion kinematics. However, the transmission system is different and operates as follows: Bevel gear 118 does not co-operate directly with the vertical shaft of the propeller unit, but with a large sprocket wheel 116, whence a c chain loop 120 leads to a small sprocket wheel 121, which co- directly with the vertical shaft of the propeller unit. The difference in the diameters of the large and small sprockets 116 and 121, i.e., the difference in the number of teeth, re in a transition ratio that increases the speed of propeller 41. This transmission is very simple, reliable and economical and its structural height is minimal, as it can be arranged flat on the upper surface of the boat.

As in the case of a bicycle, the transmission ratio can be variable, or the two sprocket wheels 116 and 121 can simply be exchanged, if this should be considered desirable (condition, abilityt, agressiveness etc.)

Anyone skilled in the art will realize that the propulsion mechanism on which the present invention is based and which consists essentially of a cable-or chain line, that is passed over guide rollers, propulsion-and/or chain wheels and one or several free-wheels, in order to drive one or several propulsion elements in the form of ships' or paddle wheels, can also be constructed in other additional embodiments, which have not been described here. Furthermore, it is possible for the various illustrated cons ion forms to be combined with one another. It is thus possible in all the above-described embodiments to design the drive mechanism in such a manner that both the push-and pull-phase produce propulsive output. It is also obvious that each embodiment can be provided with an element for storing a part of the line force, which is then converted to driving energy during the pushing phase. It is another advantage of such a construction design that the forces acting on the drive elements can be adjusted to one another during the pulling-and pushing movements and so reduce output variations. The insertion of a fly wheel can produce the same result. Furthermore, in a closed cable-and chain line utilization of elastic members as length equalisers may be unavoidable, when the effective length of the lines is altered by movement of the double lever.

An expert will also realize that the levers are not absolutely essential in the propulsion mechanism, and that it is possible to exert energy directly on to the cable pulls, at least in the direction of pull.

It may also be appropriate to connect the wire ropes with varying lever lengths to the propulsion levers, so that during the pulling phase the effective lever arm is larger than during the pushing phase, during which the expanded energy is unavoidably smaller.

Furthermore, the to-and-fro-movement of the sliding seat be be directly converted into propulsive energy, if it is joined to a separate cable and/or chain line, which, like the previously described lines, acts on one or several propulsive elements.

It can also be interesting to provide the inventive vehicle or craft with two seats, either in linear arrangement or in parallel arrangement of the two seats. The vehicle is then advantageously designed in such a way that alternately one seat produces the greater pull energy when the other seat returns in push direction to the starting position.

In addition it is easily possible for quite a range of non-inventive structural changes to be in the abovedescribed embodiments.

For Example:

In the embodiment according to FIGS. 20 21 it is Possible to attach thin stabilising discs to the arms of double lever system 125 that enter the water, said discs produce hardly any resistance because of their minimal cross section in the direction of movement. These disks would replace the keel.

Since only one propeller and one double lever are prodived in the embodiments illustrated in FIGS. 18 to the question of steering arises. It is possible, for example to provide a conventional foot steering system. However, as an alternative, a simple manual steering device can be provided which can be operated with one hand, while the other hand the driving lever. Braking handles, arranged near the handles of driving stirrup 124, which co-operate via Bowden lines with a steering device, represent another possible steering method.

Anyone skilled in the art would have no great problem in replacing the various described propulsion systems with other transmission mechanisms, such as for example flexible shafts. Similarly, it would be possible to replace the wire lines and chains by other elements, for instance V-belts, toothed belts, geared rack-and-pinion gears, etc.

It is also possible to employ instead of conventional free-wheeling mechanisms rocking mechanisms, which convert the alternating movements directly into unilateral movements.

In the event of lateral stability problems developing (the danger of tilting) it is possible to provide laterally attachable float elements, as additional parts for beginners and unpractised users. Advantageously, these are arranged at some distance from the boat, on outriggers for instance. These float elements may be inflatable articles of rubber or soft plastic, or may be manufactured from suitable plastic, i.e. polystyrene.

The fact that in the above the invention has been described merely in connection with boats and like watercraft, does not limit to such craft. Provided an adequate selection is made of propulsion members, there are no problems in equipping land-and-airborne vehicles with such members. However, it is pointed out that the invention does not aim at achieving autonomous flying capacity, but is designed for use in light airborne vehicles, for example, such as hang gliders, where the invention can be installed as an auxiliary propulsion mechanism.

I claim:

1. A vehicle actuable by muscular force comprising:

(a) a body;

(b) a seat mounted on said body;

(c) first and second levers mounted on said body adjacent said seat, each said lever including an upper end, a lower end and a pivot point between said lower end and said upper end, said pivot points being substantially coaxial;

(d) a propulsion system mounted on said body and including:

(1) a first force transmitting unit comprising an endless chain coupled with guide gears;

(2) a propulsion element coupled to said first force transmitting unit via a free wheeling connection allowing force transmission in a first direction of motion of said first force transmitting unit and allowing free wheeling of said connection in a second opposite direction of motion of said first force transmitting unit;

(e) a second force transmitting unit mounted on said body and including:

(1) an elongated member connected at one end to the lower end of said first lever and at another end thereof to said second lever between the pivot point and upper end thereof;

(2) said elongated member being affixed to said first force transmitting unit between said ends thereof;

(f) whereby pivoting of said levers simultaneously in a first direction causes movement of said first force transmitting unit in said first direction of motion thereof, and pivoting of said levers simultaneously in a second direction causes movement of said first force transmitting unit in said second direction of motion thereof.

2. The invention of claim 1, wherein said elongated member comprises a cable.

3. The invention of claim 1, wherein said elongated member one end is connected to said first lever lower end a distance from said first lever pivot point substantially identical to the distance from said second lever pivot point at which said elongated member another end is affixed.

4. The invention of claim 1, wherein said propulsion element comprises a propeller and said vehicle comprises a water craft.

5. The invention of claim 1, wherein said levers are constrained to move together.

* * * * *